US011325170B2

(12) United States Patent
Hesse et al.

(10) Patent No.: US 11,325,170 B2
(45) Date of Patent: May 10, 2022

(54) MANUALLY OPERATED DRUM-TYPE PIPE CLEANING DEVICE

(71) Applicant: ROTHENBERGER AG, Kelkheim (DE)

(72) Inventors: Dennis Hesse, Frankfurt (DE); Maximilian Gottschalk, Wiesbaden (DE)

(73) Assignee: ROTHENBERGER AG, Kelkheim (DE)

( * ) Notice: Subject to any disclaimer, the term of this patent is extended or adjusted under 35 U.S.C. 154(b) by 233 days.

(21) Appl. No.: 16/756,289

(22) PCT Filed: Nov. 15, 2018

(86) PCT No.: PCT/DE2018/100934
§ 371 (c)(1),
(2) Date: Apr. 15, 2020

(87) PCT Pub. No.: WO2019/096353
PCT Pub. Date: May 23, 2019

(65) Prior Publication Data

US 2020/0298291 A1 Sep. 24, 2020

(30) Foreign Application Priority Data

Nov. 15, 2017 (DE) ..... 10 2017 126 899.5

(51) Int. Cl.
*B08B 9/045* (2006.01)
*E03F 9/00* (2006.01)

(52) U.S. Cl.
CPC ..... *B08B 9/045* (2013.01); *E03F 9/005* (2013.01); *B08B 2209/04* (2013.01)

(58) Field of Classification Search
CPC ..... E03F 9/005; B08B 9/045; B08B 2209/04; E03C 1/302
See application file for complete search history.

(56) References Cited

U.S. PATENT DOCUMENTS 3,268,937 A 8/1966 Bollinger
3,574,878 A * 4/1971 Shames ..... E03C 1/302 15/104.33

(Continued)

FOREIGN PATENT DOCUMENTS

EP 1176112 B1 10/2004

*Primary Examiner* — Weilun Lo
(74) *Attorney, Agent, or Firm* — Smartpat PLC

(57) ABSTRACT

A drum-type pipe cleaning device comprises a drum rotatable about a rotational axis and a cleaning cable allocated to the drum. A longitudinal section of the cleaning cable extends from the drum. The longitudinal section is rotatable about its longitudinal axis through a rotation of the drum. The drum-type pipe cleaning device further comprises a handle, which is configured to support the drum in a rotatable manner. Furthermore, the drum-type pipe cleaning device comprises a drive shaft for driving the drum and an attachment point allocated to the drive shaft for connecting the drive shaft to a drive unit for drive purposes. A freewheel clutch is provided, through which the drive shaft is or can be connected to the drum in an operative manner such that the freewheel clutch is engaged when the drive shaft is being driven and the freewheel clutch runs freely when the drum is being driven.

9 Claims, 3 Drawing Sheets

(56) References Cited

U.S. PATENT DOCUMENTS

| | | | | |
|---|---|---|---|---|
| 4,218,802 | A | 8/1980 | Babb et al. | |
| 4,304,372 | A | 12/1981 | Smith et al. | |
| 4,364,139 | A * | 12/1982 | Babb | E03F 9/005 15/104.33 |
| 4,956,889 | A * | 9/1990 | Kirk | E03F 9/005 15/104.33 |
| 5,265,301 | A | 11/1993 | Irwin | |
| 6,381,798 | B1 * | 5/2002 | Rutkowski | B08B 9/045 15/104.33 |
| 9,234,342 | B1 * | 1/2016 | Beesley | E03C 1/302 |
| 2002/0027178 | A1 | 3/2002 | Lindermeir et al. | |
| 2004/0194241 | A1 * | 10/2004 | Hale | B08B 9/045 15/104.33 |
| 2005/0193509 | A1 * | 9/2005 | Rutkowski | B65H 75/4471 15/104.33 |
| 2013/0160227 | A1 * | 6/2013 | Rutkowski | G05G 5/00 15/104.33 |
| 2014/0223679 | A1 | 8/2014 | Silverman et al. | |
| 2016/0263631 | A1 * | 9/2016 | Kane | B08B 9/043 |
| 2017/0268596 | A1 * | 9/2017 | Cole | E03F 9/005 |
| 2018/0051454 | A1 * | 2/2018 | Hoyt | B65H 75/364 |
| 2018/0142458 | A1 * | 5/2018 | Bowles | E03C 1/302 |

* cited by examiner

MANUALLY OPERATED DRUM-TYPE PIPE CLEANING DEVICE

TECHNICAL FIELD

The invention relates to a manually operated drum-type pipe cleaning device.

BACKGROUND

Pipe cleaning devices are used to clean sewage or rainwater pipelines, for example to remove obstructions or other blockages in the flow path. For this purpose, the pipe cleaning devices have a cleaning cable that is inserted into the pipeline and set in rotation. The rotation causes the cleaning cable to wind through the pipeline.

Typically, a replaceable cleaning tool is mounted on the front end of the cleaning cable, the output end. At the rear end, the cleaning cable is mounted in a rotatably driven drum and can be moved from there, for example by a feed device acting on the cleaning cable, and also retracted back into the drum. The rotational movement of the drum causes the rotational movement of the cleaning cable.

The pipe cleaning devices are designed in such a manner that they can be held in the hands of a user during operation. A handle is typically provided for this purpose. For example, the handle is designed in such a manner that the drum is supported in a rotatable manner. Often, the user can operate the feed device by means of the handle.

SUMMARY

One object of the invention is to further develop a manually operated drum-type pipe cleaning device of the type mentioned above with regard to handling and user-friendliness.

This object is achieved with a manually operated drum-type pipe cleaning device as claimed and a manually operated drum-type pipe cleaning apparatus as claimed.

A basic manually operated drum-type pipe cleaning device comprises a drum rotatable about a rotational axis and a cleaning cable allocated to the drum, wherein a longitudinal section of the cleaning cable extends from the drum, in particular extends away from it, and, through or via the rotation of the drum, the longitudinal section is or becomes rotatable about its longitudinal axis. For example, the cleaning cable is held in or inside or on the drum, in particular at least partially.

The manually operated drum-type pipe cleaning device, hereinafter also referred to as the pipe cleaning device for short, also comprises a handle, which is configured in particular to support the drum in a rotatable manner. This means, in particular, that the drum is or can be held by the handle in a rotatable manner. Furthermore, the pipe cleaning device can include a feed device to bring the cleaning cable into a forward or a backward movement.

With one embodiment, the pipe cleaning device comprises a drive shaft for driving the drum and an attachment point allocated to the drive shaft, in order to connect the drive shaft to a drive unit, in particular an output shaft of the drive unit. Due to the attachment point, the drive unit for driving the drum does not need to be an integral component of the pipe cleaning device. Rather, where required, a suitable drive unit can be coupled to it for drive purposes. This makes it possible, for example, to use commercially available cordless screwdrivers, drills or other power tools or electric tools as the drive unit to drive the drum. This results in a cost advantage for the proposed pipe cleaning device, since a drive unit already available for other applications can be used as the drive unit to drive the drum. The attachment point can be formed by a longitudinal section of the drive shaft which, for example, is designed to be polygonal in cross-section, in particular hexagonal.

With an additional embodiment, the pipe cleaning device comprises a freewheel clutch, through which the drive shaft is or can connected to the drum in an operative manner such that the freewheel clutch is engaged when the drive shaft is being driven and runs freely when the drum is being driven; that is, the freewheel clutch performs an engagement function when the drive shaft is being driven and a freewheel function when the drum is being driven. The freewheel clutch is understood in particular to be a mechanical freewheel clutch. In particular, the freewheel clutch is a mechanical apparatus that is used to transmit power and includes the freewheel function described above. In particular, the freewheel clutch is to be understood to be a switchable clutch that switches automatically depending on the rotational movement and/or the torque of the drive shaft relative to the drum, wherein, for example, the freewheel clutch performs the freewheel function in one switching state and performs the engagement function in another switching state. In particular, the engagement function is understood to mean that the drive shaft and the drum are connected to one another for drive purposes. The freewheel function is understood to mean in particular that the drive shaft and the drum are decoupled from one another for drive purposes.

Through the freewheel clutch, a measure is taken to avoid torques acting on an operator of the drive unit or to counteract such torques if the drive power of the drive unit is throttled, for example during a switch-off process. In this operating state, the mass inertia of the drum, and in particular the mass inertia of the cleaning cable, becomes noticeable; this acts as an energy storage for at least a part of the kinetic energy generated by the drive unit.

When throttling the rotational speed of the drive unit, it happens that, when the rotational speed of the drive unit falls below a certain level, the drum will strive to take along in a driving manner the input shaft and thus the output shaft of the drive unit. In order to prevent the drive unit from also rotating, the operator must hold the drive unit firmly in place. However, this can mean a relatively large exertion of force by the operator, for example if the drive unit is switched off abruptly and the stored kinetic energy builds up at the drive unit in the form of pulses. Through the freewheel clutch, this condition is counteracted, since, when the drum is being driven, the freewheel clutch performs its freewheel function; that is, no transmission of power takes place between the drive shaft and the drum. Simply this results in advantages in the handling of the pipe cleaning device. This also facilitates operation.

In addition, the freewheel clutch can be configured so that the operative connection between the attachment point and the drum acts in only one direction of rotation of the drum, that is, it is engaged, and the freewheel clutch runs freely in the other direction of rotation of the drum. This means that a measure is taken to ensure that any counter-torque generated, for example, by the drum and the cleaning cable can act on the drive shaft of the pipe cleaning device and thus on the drive unit.

According to one embodiment or configuration of the pipe cleaning device, it is provided that the freewheel clutch is present in a geometric arrangement in a radial manner between the drive shaft and an intermediate shaft that is connected in a torsionally rigid manner to the drum or molded onto the drum, and for this purpose at least one of the two shafts is designed as a hollow shaft in which the other shaft and the freewheel clutch are accommodated. This favors a technically simple structure of the pipeline device taking into account the freewheel coupling. For example, the hollow shaft is arranged in a manner concentric with the freewheel clutch, and the hollow shaft and the freewheel clutch are both in turn concentric with the other shaft.

According to an additional embodiment or configuration of the pipe cleaning device, it is provided that the freewheel clutch is seated on the drive shaft and is overlapped by the intermediate shaft, wherein the intermediate shaft is pushed onto the drive shaft and is arranged in the axial direction between two stops, through which the intermediate shaft is secured against axial detachment from the drive shaft. For example, it is provided that at least one of the stops is connected to the drive shaft in a non-displaceable manner; thus, it is connected in a fixed manner in the axial direction. Both stops can also be connected to the drive shaft in a non-displaceable manner. It is also possible that at least one of the stops is formed on the drive shaft.

Alternatively, it can be provided that the freewheel clutch sits on the intermediate shaft and is overlapped by the drive shaft, wherein the drive shaft is pushed onto the intermediate shaft and is arranged in the axial direction between two stops, through which the drive shaft is secured against axial detachment from the intermediate shaft. For example, it is provided that at least one of the stops is connected to the intermediate shaft in a non-displaceable manner; thus, it is connected in a fixed manner in the axial direction. Both stops can also be connected to the intermediate shaft in a non-displaceable manner. It is also possible that at least one of the stops is formed on the intermediate shaft.

It is useful that one of the stops is connected to the drive shaft in a non-detachable manner or is molded onto the drive shaft. The non-detachable connection between one stop and the drive shaft is understood to mean in particular that the stop can only be detached from the drive shaft by destroying at least one of the components. For example, a non-detachable connection is realized by welding or other thermal joining. It is also useful that the other stop is arranged on the drive shaft in a detachable manner; in particular, it is formed or enclosed by a securing element fastened to the drive shaft in a detachable manner. Alternatively, it can also be provided that one of the stops is connected to the intermediate shaft in a non-detachable manner or is formed on the intermediate shaft and the other stop is arranged on the intermediate shaft in a detachable manner; in particular, it is formed or enclosed by a securing element fastened to the intermediate shaft in a detachable manner.

In particular, it is provided that the securing element is arranged or is located in the area of an interior space of the drum. Thereby, the detachable stop is accommodated in a manner protected from the outside. An unintentional loosening of the stop from the drive shaft, for example by external influences or third parties, is made more difficult by this protected arrangement. For example, one stop is formed on the drive shaft by forming one stop through a shaft collar, a shaft shoulder or the like or has such a formation.

The interior space of the drum can be realized by the drum comprising a front side and a rear side, wherein, for example, the rear side is connected to the front side in a detachable manner, in order to provide access to the cleaning cable, which is at least partially wound up in the drum. The interior space of the drum can be understood as the intermediate space between the front side and the back side in which the cleaning cable is wound up.

An additional embodiment or configuration of the pipe cleaning device is that the drive shaft, the intermediate shaft and the freewheel clutch form a common structural unit, which is fastened to or mounted on the drum in a detachable manner. Such measure aims to facilitate the installation of the freewheel clutch. The structural unit makes it easier, for example, to carry out pre-assembly and thus to realize the structural unit as a pre-assembled structural unit, for example to enable a quick and easy replacement in the case of a design of the pipe cleaning device without a freewheel clutch.

For example, it is provided that the intermediate shaft, in particular by means of a flange, is connected to a rear wall of the drum in a torsionally rigid manner and that the intermediate shaft, in particular the flange, can be detached from the rear wall and/or the rear wall can be detached from the drum. This means that the rear wall and the intermediate shaft or flange, as the case may be, can be made of different materials. For example, the rear wall is a plastic part and the flange and/or the intermediate shaft is a metal part. In principle, the drum and/or the rear wall of the drum can be made of plastic or can comprise plastic material. In principle, the intermediate shaft and/or the drive shaft can also be a metal part.

Alternatively or in addition, it can be provided that the drive shaft, the intermediate shaft, the freewheel clutch and one or the rear wall of the drum form a common structural unit, wherein the intermediate shaft and the rear wall are connected to one another in a torsionally rigid and non-detachable manner or are molded onto one another, and the rear wall is connected to the drum in a detachable manner; in particular, the rear wall is mounted or fastened to the drum in a detachable manner. Thereby, the rear wall of the drum also forms an integral component of the structural unit. This measure also aims at facilitating the installation of the freewheel clutch. The structural unit can be pre-assembled, for example, to enable quick and easy replacement in the case of a design of the pipe cleaning device without a freewheel clutch.

With an additional embodiment or configuration of the pipe cleaning device, it is provided that the drive shaft and the intermediate shaft are mounted against one another in the radial direction, and for this purpose at least one, preferably two bearings are provided, which are spaced apart from one another in the axial direction and the freewheel clutch is arranged between them. This measure aims at bringing the drive shaft and the intermediate shaft into a stable and durable arrangement in relation to one another, without impairing the freewheel function of the freewheel clutch, that is, the freewheel of the intermediate shaft in relation to the drive shaft. The at least one bearing or at least one of the bearings can be a slide bearing. In principle, the use of a rolling bearing is also possible.

For example, the at least one bearing or at least one of the bearings performs a function as a thrust bearing, for example to realize an axial bearing arrangement against the associated stop. In this case, the end face of the intermediate shaft can be arranged against the stop of the drive shaft and/or the end face of the intermediate shaft against the securing element or, if necessary, against a disk element or securing disk arranged upstream of the securing element.

The freewheel clutch can be or comprise a roller freewheel and/or a sprag-type freewheel and/or a ratchet freewheel and/or a claw ring freewheel. The freewheel clutch can also be or comprise a wrap spring clutch and/or a self-synchronizing shifting clutch. The decisive factor is that the freewheel clutch performs the freewheel function described above in the manner described above.

According to an additional aspect, a manually operated drum-type pipe cleaning apparatus is provided. The pipe cleaning apparatus comprises the pipe cleaning device described above or at least one configuration or embodiment of the pipe cleaning device along with a drive unit that is coupled to the drive shaft of the pipe cleaning device for drive purposes.

Further details and features of the invention arise in the following description of an exemplary embodiment on the basis of the drawings.

DETAILED DESCRIPTION

Figure 1:
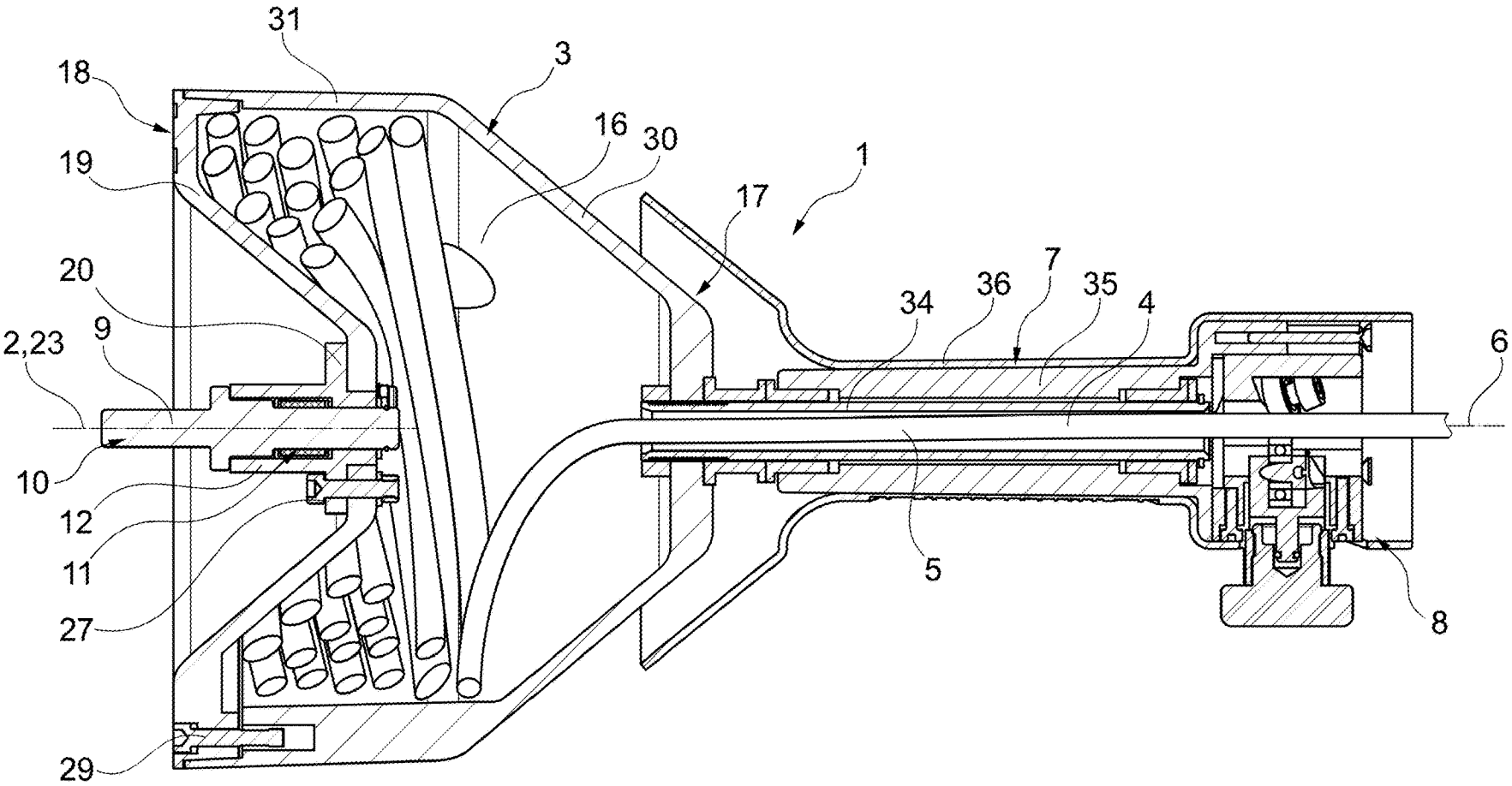
FIG. 1 shows a possible embodiment of a manually operated drum-type pipe cleaning device in a sectional view.

FIG. 1 shows—in a schematic representation—a possible embodiment of a manually operated drum-type pipe cleaning device 1, which will be referred to as pipe cleaning device 1 for short in the following. The pipe cleaning device 1 is used, for example, to clean pipelines and/or sewers for wastewater or rainwater, for example, to remove obstructions or other blockages that have arisen in the flow.

The pipe cleaning device 1 comprises a drum 3 that can be rotated about a rotational axis 2. The pipe cleaning device 1 further comprises a cleaning cable 4 held at least partially within or on the drum 3, wherein a longitudinal section 5 of the cleaning cable 4 extends away from the drum 3 and, through or via rotation of the drum 3, the longitudinal section 5 is or can be rotated around its longitudinal axis. For example, the longitudinal axis of the longitudinal section 5 of the cleaning cable 4 and the axis of rotation 2 of the drum 3 lie on a common axis or are arranged at a distance from one another; in particular, they are arranged at a distance in parallel.

In addition, the pipe cleaning device 1 comprises a handle 7 and, for example, a feed device 8. The handle 7, for example, is configured to rotatably support or hold the drum 3. The feed device 8 is used to bring the cleaning cable 4 into a forward or backward movement. For example, the handle 7 is designed as a pipe element. For example, the handle 7 is constructed in at least two parts. For example, the handle 7 comprises at least two handle parts 35 and 36, which are preferably connected to one another in a torsionally rigid manner. Each of the handle parts 35, 36 can have tubular form. For example, the handle parts 35, 36 are plugged into one another and one of the handle parts 35, 36, in particular the handle part 36, forms an outer sleeve, which for example has a graspable gripping surface. The handle 7 can embrace an inner pipe 34 that is connected to the drum 3 in a torsionally rigid manner and can be mounted so as to be rotatable against it. The inner pipe 34 forms, for example, a connecting element for the cleaning cable 4 from the drum 3 to the feed device 8, wherein the longitudinal section 5 of the cleaning cable 4 is preferably accommodated in the inner pipe 34. Preferably, the feed device 8 is connected to the handle 7 in a torsionally rigid manner.

Furthermore, the pipe cleaning device 1 comprises a drive shaft 9 for driving the drum 3. For this purpose, the drive shaft 9 is or can be connected to the drum 3 in an operative manner. Preferably, the axis of rotation 2 of the drum 3 and the shaft axis 23 of the drive shaft 9 are arranged coaxially to one another. An attachment point 10 is assigned to the drive shaft 9 in order to connect the drive shaft 9 to a drive unit (not shown in FIG. 1) for drive purposes. Preferably, the pipe cleaning device 1 is geometrically constructed in such a manner that, starting from the attachment point 10, the following components are arranged one behind the other in the following order: the drive shaft 9, the drum 3, the handle 7, the feed device 8. A section of the cleaning cable 4 protrudes at the end from the feed device 8, which is incompletely shown in FIG. 1. Thereon, a cleaning tool (not shown in FIG. 1) is arranged at the head end; this forms the output end of the cleaning cable 4 and can be implemented as an exchange element.

The attachment point 10 can be a longitudinal section of the drive shaft 9, which is designed to be angular in cross-section, in particular polygonal, such as hexagonal. In principle, the longitudinal section of the drive shaft 9 used as an attachment point can also be designed to be round, in particular circular or oval. In particular, the attachment point 10 is designed to connect a power tool, such as a cordless screwdriver, a drill or any other power tool, which is preferably an electrically driven power tool and is to be held in the hand during operation. For example, the longitudinal section is designed as a hexagon, in order to enable a drill chuck of a drive unit, such as a cordless screwdriver or an electric drill, to be coupled to it for drive purposes.

In order to avoid any torque, for example an impulse-like torque acting on the operator of the drive unit when the rotational speed of the drive unit is reduced or the drive unit is switched off, which can have an after-effect, for example due to the mass inertia of the drum 3, the pipe cleaning device 1 has a freewheel clutch 11. Via the freewheel clutch 11, the drive shaft 9 is or can be connected to the drum 3 in an operative manner such that the freewheel clutch 11 is engaged when the drive shaft 9 is being driven, that is, a drive torque is transmitted, and the freewheel clutch 11 runs freely when the drum 3 is being driven, that is, there is no transmission of power between the drive shaft 9 and the drum 3. In addition, the freewheel clutch 11 can perform a function such that it is only engaged in one direction of rotation of the drum 3 and runs freely in the other direction of rotation of the drum 3.

Figure 2:
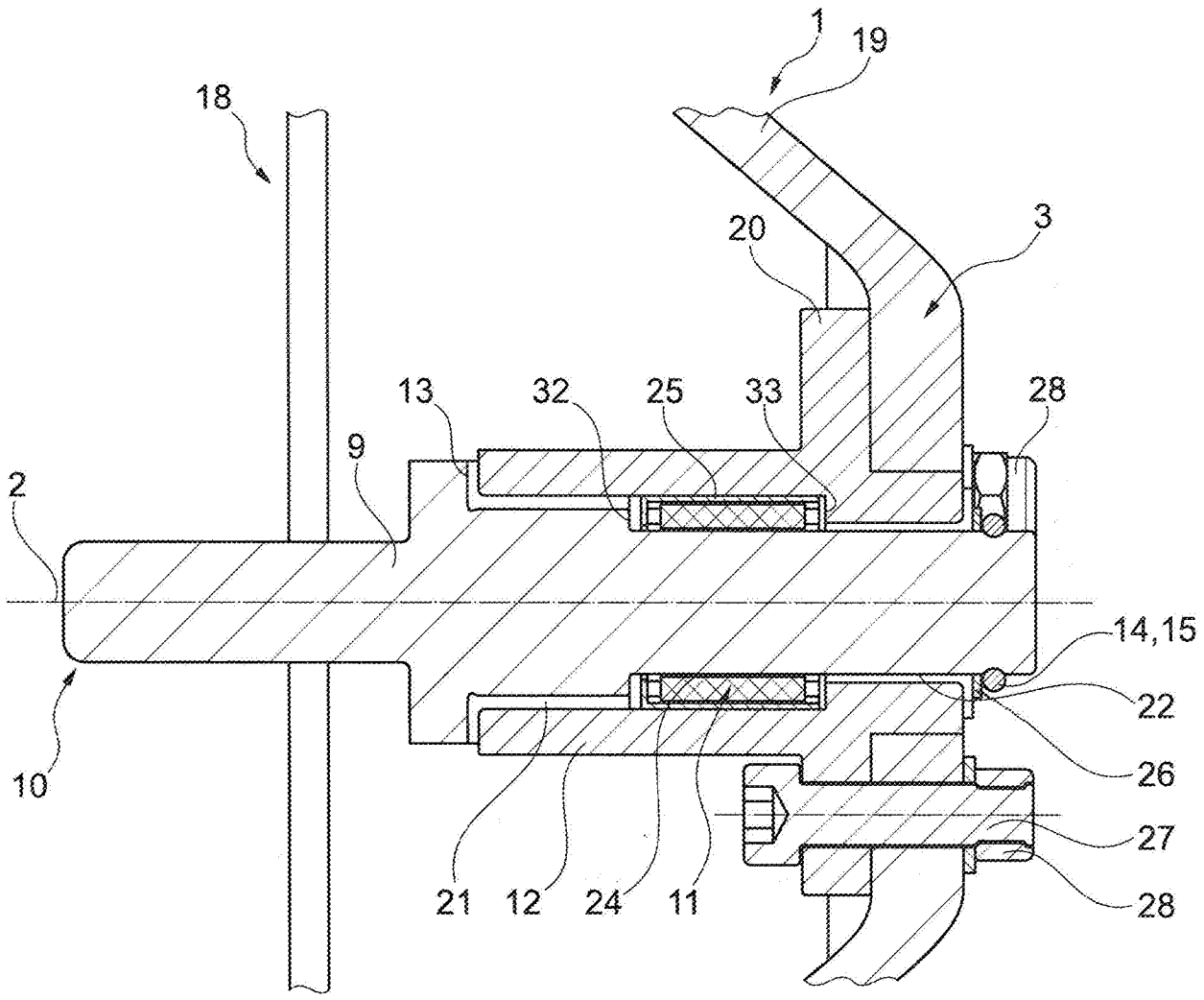
FIG. 2 shows an enlarged section from FIG. 1 in the area of a freewheel coupling of the pipe cleaning device.
Figure 3:
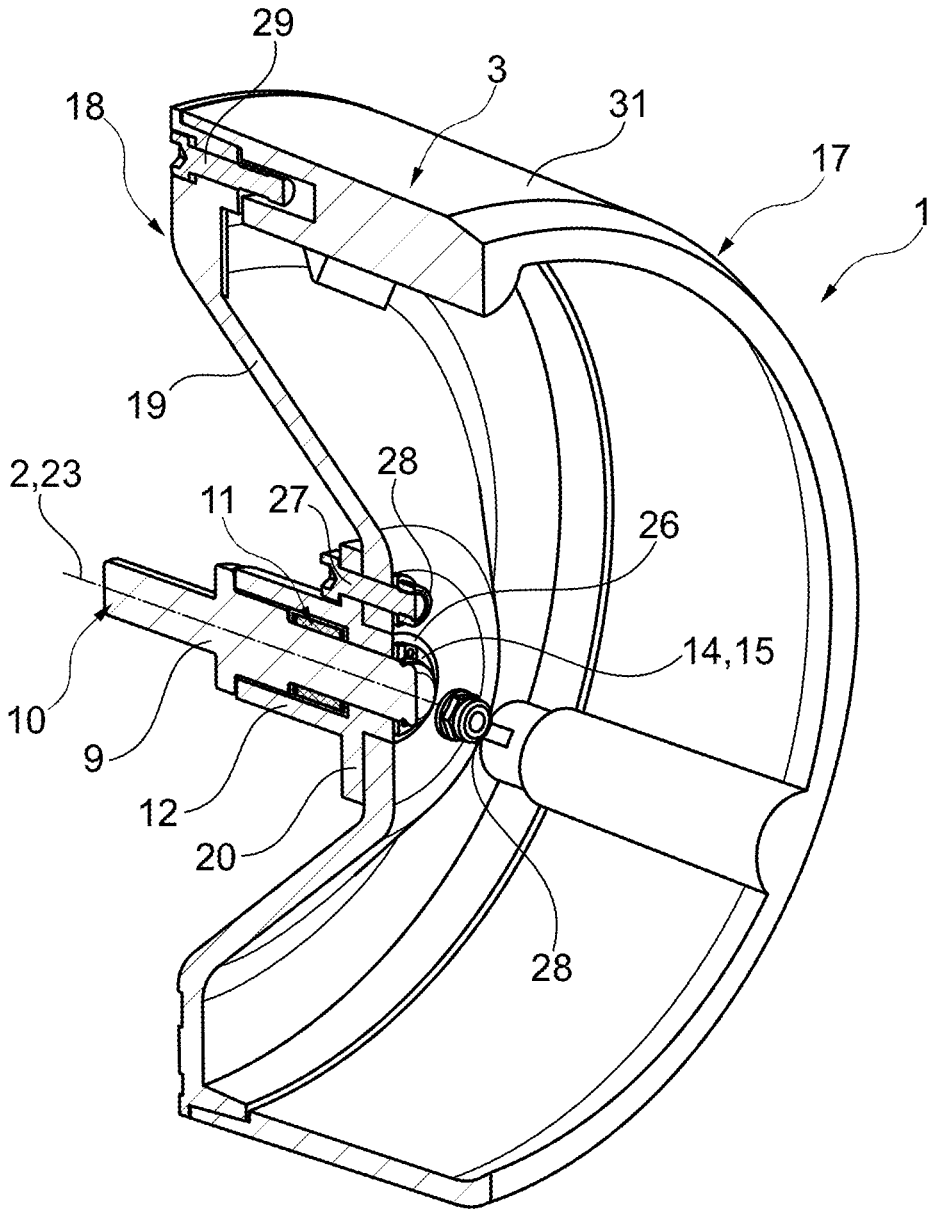
FIG. 3 shows the pipe cleaning device according to FIG. 1 in the area of its freewheel clutch in a perspective view as a partial section.

FIG. 2 shows the pipe cleaning device 1 of FIG. 1 in an area of the freewheel clutch 11 as an enlarged view. FIG. 3 shows the pipe cleaning device 1 in the area of the freewheel clutch 11 in a perspective view of a rear side 18 of the drum 3 as a partial section. As can be seen in particular from this, the freewheel clutch 11 is provided in a geometrical arrangement in a radial manner between the drive shaft 9 and an intermediate shaft 12 that is connected to the drum 3 in a torsionally rigid manner. For this purpose, the intermediate shaft 12 is preferably designed as a hollow shaft, in which the drive shaft 9 and the freewheel clutch 11 are accommodated. For example, the intermediate shaft 12 is arranged in a manner concentric with the freewheel clutch 11, and the intermediate shaft 12 and the freewheel clutch 11 are in turn arranged in a manner concentric with the drive shaft 9.

Preferably, the freewheel clutch 11 sits on the drive shaft 9 and is overlapped by the intermediate shaft 12, wherein the intermediate shaft 12 is pushed onto the drive shaft 9. To secure the intermediate shaft 12 relative to the drive shaft 9 in the axial direction against loosening, two stops 13, 14, between which the intermediate shaft 12 is arranged, can be provided. For example, one of the stops 13, 14, in particular the stop 13, is formed on the drive shaft 9. For example, the stop 13 is formed by a shaft collar or shaft shoulder of the drive shaft 9. For example, the other of the stops 13, 14, in particular the stop 14, is formed by a securing element 15, which is fixed to the drive shaft 9 in a detachable manner. The securing element 15 can be a securing ring, which embraces the drive shaft 9; in particular, it engages in a notch on the outer circumference of the drive shaft 9.

Furthermore, between the axial end of the intermediate shaft 12, which faces the securing element 15, and the securing element 15, an intermediate element 26, such as a disk-shaped intermediate element, such as a ring washer or adjusting washer, can be pushed onto the drive shaft 9. Preferably, the drive shaft 9 with its mounted securing element 15 is coupled to the drum 3 in such a manner that the securing element 15 is located in the area of an interior space 16 of the drum 3 or is at least accessible via the interior space 16 of the drum 3. In this case, the other stop 13 is preferably arranged in a manner facing the attachment point 10.

The freewheel clutch 11 can be a roller freewheel, such as a drawn cup roller clutch with steel springs. The freewheel clutch 11 can also be a sprag-type freewheel or a ratchet freewheel or a claw ring freewheel. The freewheel clutch 11 preferably has an inner part 24 and an outer ring 25 surrounding the inner part 24, which is preferably arranged coaxially to the inner part 24. Preferably, the outer ring 25 is connected to the intermediate shaft 12 in a torsionally rigid manner. In particular, the outer ring 25 is inserted with its outer circumference into the intermediate shaft 12; in particular, it is pressed into an interference fit.

Preferably, the inner part 24 is connected to the drive shaft 9 in a torsionally rigid manner. For example, the inner part 24 is designed as a ring and is pushed onto the drive shaft 9; in particular, it is pressed on with an interference fit. The drive shaft 9 can also form the inner part 24. The inner part 24 is then formed by the drive shaft 9. In this case, the drive shaft 9 is an integral component of the freewheel clutch 11.

The inner part 24 and the outer ring 25 are schematically indicated in FIG. 2. Preferably, a clutch mechanism of the freewheel clutch 11 is arranged or formed between the inner part 24 and the outer ring 25, wherein the inner part 24 and the outer ring 25 can also be components of the clutch mechanism. Such clutch mechanism is configured so that the freewheel clutch 11 is engaged when the drive shaft 9 is being driven and the freewheel clutch 11 runs freely when the drum 3 is being driven. Thus, the inner part 24 and the outer ring 25 are connected to one another in a torsionally rigid manner when the freewheel clutch 11 is engaged, that is, when an engagement function is exercised. On the other hand, the inner part 24 and the outer ring 25 can rotate relative to one another if the freewheel clutch 11 runs freely, that is, performs its freewheel function.

Preferably, the freewheel clutch 11 is also configured so that it is only engaged in one direction of rotation of the drive shaft 9 and runs freely in the other direction of rotation of the drive shaft 9. For this purpose, the clutch mechanism uses clamping rollers or other sprags, rachets, claw rings or a wrap spring, depending on which type of freewheel is used for the freewheel clutch 11. Preferably, the clutch mechanism also uses spring elements, in order to, for example, press the clamping rollers provided between the inner part 24 and the outer ring 25 into a force-transmitting position.

In order to facilitate the assembly of the pipe cleaning device 1, it is preferably provided that the drive shaft 9, the intermediate shaft 12 and the freewheel clutch 11 form a common structural unit, which is fastened to the drum 3 in a detachable manner. For example, the intermediate shaft 12 is connected in a torsionally rigid and detachable manner to the drum 3 via a flange 20. For example, the flange 20 is fastened to a rear wall 19 of the drum 3. It is possible that the flange 20 can be detached from the rear wall 19 and/or the rear wall 19 can be detached from the drum 3. For example, the flange 20 is connected to the rear wall 19 by means of at least one screw-nut connection, wherein at least one screw element 27 and a nut element 28 screwed thereto can be used. For example, the rear wall 19 is also fastened to the drum 3 by means of a plurality of screw elements 29.

Preferably, the drum 3 comprises a front side 17 and a rear side 18, which is connected to the front side 17 in a detachable manner, in order to provide access to the cleaning cable 4, which is at least partially wound up in the drum 3. The rear side 18 is formed by or comprises the rear wall 19, for example, to which the drive shaft 9 is coupled with the interposition of the freewheel clutch 11. For example, the front side 17 comprises a housing spanning the interior space 16, in which the cleaning cable 4 is housed. Preferably, the housing has an essentially funnel-shaped or conical section 30, which tapers in the direction of the handle 7 and thus widens in the direction of the rear wall 19. Preferably, an essentially cylindrical section 31 of the housing is attached thereto at the rear wall 19.

The rear wall 19 can be designed in the manner of a funnel, wherein this funnel-shaped configuration tapers in the direction of the handle 7, such that the rear wall 19 is recessed in the center, that is, in the area of the drive shaft 9. Preferably, such recess is designed in such a manner that the intermediate shaft 13 is sunk in the recess and only the drive shaft 9 with its attachment point 10 protrudes from it. Preferably, the intermediate shaft 12 passes through a passage opening of the rear wall 19 with one end, wherein the edge of the passage opening can be supported on the intermediate shaft 12.

Preferably, the intermediate shaft 12 is rotatably mounted in the radial direction against the drive shaft 9. In addition, the intermediate shaft 12 can also be rotatably mounted in the axial direction against the drive shaft 9. For this purpose, preferably at least one, preferably two bearings 21, 22 are provided, which are spaced apart from one another in the axial direction and between which the freewheel clutch 11 is arranged. Preferably, at least one of the bearings 21, 22 or both bearings 21, 22 are designed as slide bearings. For example, the slide bearing is realized by a bushing or the like, by which a bearing arrangement acting in the axial direction can be realized between the end face of the intermediate shaft 12 and the respective associated stop 13 or 14, as the case may be, of the drive shaft 9 by means of a radially outwardly projecting and preferably rotating radial collar of the bushing. In principle, it is also possible that at least one of the bearings 21, 22 or both bearings 21, 22 are eliminated, and the freewheel clutch 11 provides a bearing arrangement in the radial and/or axial direction in a corresponding manner.

The drive shaft 9 can have a shoulder 32, such as a shaft collar or the like, which is provided for structural reasons, for example in order to be able to install the bearing 21 with a larger inside diameter than the bearing 22. For example, the drive shaft 9 then has a larger diameter in the area of the bearing 21 than in the area of the bearing 22 and possibly in the area of the freewheel clutch 11, such that, for example, it is possible to push on the drive shaft 9 from one end. Furthermore, a shoulder 33, such as a shaft collar or the like, can be formed on the intermediate shaft 12, which can serve as a positioning aid during installation, in particular pressing in the freewheel clutch 11.

Due to the freewheel clutch 11, the pipe cleaning device 1, for example, has the following functions: a drive unit coupled to the attachment point 10 for drive purposes is started and the drum 3 is thereby set in rotational movement. In such operating state, the freewheel clutch 11 is engaged. When the drive unit is switched off, the freewheel function of the freewheel clutch 11 is used and the drum 3 can run out freely in its rotational movement, even if the output shaft of the drive unit is already stationary.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

LIST OF REFERENCE SIGNS

1 Manually operated drum-type pipe cleaning device, pipe cleaning device
2 Rotational axis
3 Drum
4 Cleaning cable
5 Longitudinal section
6 Longitudinal axis
7 Handle
8 Feed device
9 Drive shaft
10 Attachment point
11 Freewheel clutch
12 Intermediate shaft
13 Stop
14 Stop
15 Securing element
16 Interior space
17 Front side
18 Rear side
19 Rear wall
20 Flange
21 Bearing
22 Bearing
23 Shaft axis
24 Inner part
25 Outer ring
26 Intermediate element
27 Screw element
28 Nut element
29 Screw element
30 Conical section
31 Cylindrical section
32 Shoulder
33 Shoulder
34 Inner pipe
35 Handle part
36 Handle part

The invention claimed is:

1. A drum-type pipe cleaning device (1), comprising:

a drum (3) rotatable about a rotational axis (2);

a cleaning cable (4) allocated to the drum (3), wherein a longitudinal section (5) of the cleaning cable (4) extends from the drum (3) and the longitudinal section (5) is rotatable about its longitudinal axis (6) through a rotation of the drum (3);

a handle (7), which is configured to support the drum (3) in a rotatable manner;

a drive shaft (9) for driving the drum (3) and an attachment point (10) allocated to the drive shaft (9) for connecting the drive shaft (9) to a drive unit for drive purposes; and a freewheel clutch (11), through which the drive shaft (9) is or can be connected to the drum (3) in an operative manner such that the freewheel clutch (11) is engaged when the drive shaft (9) is being driven and the freewheel clutch (11) runs freely when the drum (3) is being driven.

2. The pipe cleaning device according to claim 1, further comprising an intermediate shaft (12) which is connected in a torsionally rigid manner to the drum (3), wherein the freewheel clutch (11) is arranged radially between the drive shaft (9) and the intermediate shaft (12), and wherein at least one of the drive shaft (9) or the intermediate shaft (12) is a hollow shaft and wherein another of the drive shaft (9) or the intermediate shaft (12) and the freewheel clutch (11) are accommodated in the hollow shaft.

3. The pipe cleaning device according to claim 2, wherein the freewheel clutch (11) is seated on the drive shaft (9) and is overlapped by the intermediate shaft (12), wherein the intermediate shaft (12) is pushed onto the drive shaft (9) and is axially arranged between two stops (13, 14), and wherein the two stops secure the intermediate shaft (12) against axial detachment from the drive shaft (9).

4. The pipe cleaning device according to claim 3, wherein one of the two stops (13, 14) is connected to the drive shaft (9) in a non-detachable manner or is formed on the drive shaft (9), and wherein another of the two stops (14) is formed by a securing element (15) that is arranged on the drive shaft (9) in a detachable manner and is located in an area of an interior space (16) of the drum (3).

5. The pipe cleaning device according to claim 2, wherein the drive shaft (9), the intermediate shaft (12) and the freewheel clutch (11) form a common structural unit, which is fastened to the drum (3) in a detachable manner.

6. The pipe cleaning device according to claim 2, wherein the intermediate shaft (12) is connected to a rear wall (19) of the drum (3) in a torsionally rigid manner, and wherein the intermediate shaft (12) can be detached from the rear wall (19) and/or the rear wall (19) can be detached from the drum (3).

7. The pipe cleaning device according to claim 2, wherein the drive shaft (9) and the intermediate shaft (12) are mounted against each other in the radial direction by two axially spaced apart bearings (21, 22) and wherein the freewheel clutch (11) is arranged between the two bearings (21, 22).

8. The pipe cleaning device according to claim 7, wherein at least one of the two bearings (21, 22) is a thrust bearing.

9. The pipe cleaning device according to claim 1, wherein the freewheel clutch (11) comprises at least one of a roller freewheel, a sprag-type freewheel, a ratchet freewheel and a claw ring freewheel.

* * * * *